US007418743B2

(12) United States Patent
Tsujimoto

(10) Patent No.: US 7,418,743 B2
(45) Date of Patent: Sep. 2, 2008

(54) GROIN PROTECTOR FOR COMBAT SPORTS

(75) Inventor: Takeshi Tsujimoto, 28-3, Nishiki-cho, Kawachinagano-shi, Osaka 586-0031 (JP)

(73) Assignee: Takeshi Tsujimoto, Osaka (JP)

( * ) Notice: Subject to any disclaimer, the term of this patent is extended or adjusted under 35 U.S.C. 154(b) by 182 days.

(21) Appl. No.: 11/021,584

(22) Filed: Dec. 22, 2004

(65) Prior Publication Data

US 2005/0177931 A1 Aug. 18, 2005

(30) Foreign Application Priority Data

Feb. 16, 2004 (JP) ..... 2004-038569

(51) Int. Cl.
*A41D 13/00* (2006.01)

(52) U.S. Cl. ..... 2/466

(58) Field of Classification Search ..... 2/455, 2/456, 463, 464, 465, 22, 227, 403, 404, 2/466

See application file for complete search history.

(56) References Cited

U.S. PATENT DOCUMENTS

| | | | | | |
|---|---|---|---|---|---|
| 849,471 | A | | 4/1907 | Gamble | |
| 1,381,254 | A | * | 6/1921 | Thorp | 602/72 |
| 1,720,439 | A | * | 7/1929 | Richardson | 2/466 |
| 2,266,062 | A | * | 12/1941 | Montmarquet | 602/72 |
| 3,176,686 | A | | 4/1965 | Barnes | |
| 3,782,375 | A | | 1/1974 | Donars | |
| 3,880,160 | A | * | 4/1975 | Hall | 602/70 |
| 4,453,541 | A | * | 6/1984 | Castelli et al. | 602/72 |
| 4,811,427 | A | * | 3/1989 | Regan | 2/466 |
| 4,989,594 | A | * | 2/1991 | Doherty et al. | 602/72 |
| 5,012,802 | A | * | 5/1991 | Bischoff | 602/73 |
| 5,295,267 | A | * | 3/1994 | Galindo | 2/466 |
| 5,937,447 | A | * | 8/1999 | Howell | 2/463 |
| 5,966,747 | A | * | 10/1999 | Crupi et al. | 2/466 |
| 6,048,327 | A | * | 4/2000 | Kieffer | 602/70 |

FOREIGN PATENT DOCUMENTS

| | | |
|---|---|---|
| DE | 432538 | 8/1926 |
| DE | 3610926 A1 | 10/1987 |
| DE | 20003838 U1 | 8/2000 |
| GB | 637344 | 5/1950 |
| WO | WO 02/078799 A1 | 10/2002 |

* cited by examiner

*Primary Examiner*—Tejash Patel
(74) *Attorney, Agent, or Firm*—Knobbe Martens Olson & Bear, LLP

(57) ABSTRACT

It is an object of the present invention to provide a convenient groin protector for combat sports capable of reliably preventing the position of the plate-like rigid body of the groin protector body from being deviated during a match, and capable of wearing and taking off the groin protector in a short time. The groin protector comprises, for wearing the protector body, a waist belt made of inelastic band-like member which is attached such that the plate-like rigid body 1 is suspended and which is wound around and attached to a hip of the player M, and a surface fastener type belt retaining mechanism 3 which retains so that the waist belt 2 is not loosened in a state in which the waist belt 2 is wound around the hip of the player M and fastened.

5 Claims, 10 Drawing Sheets

【FIG. 1】
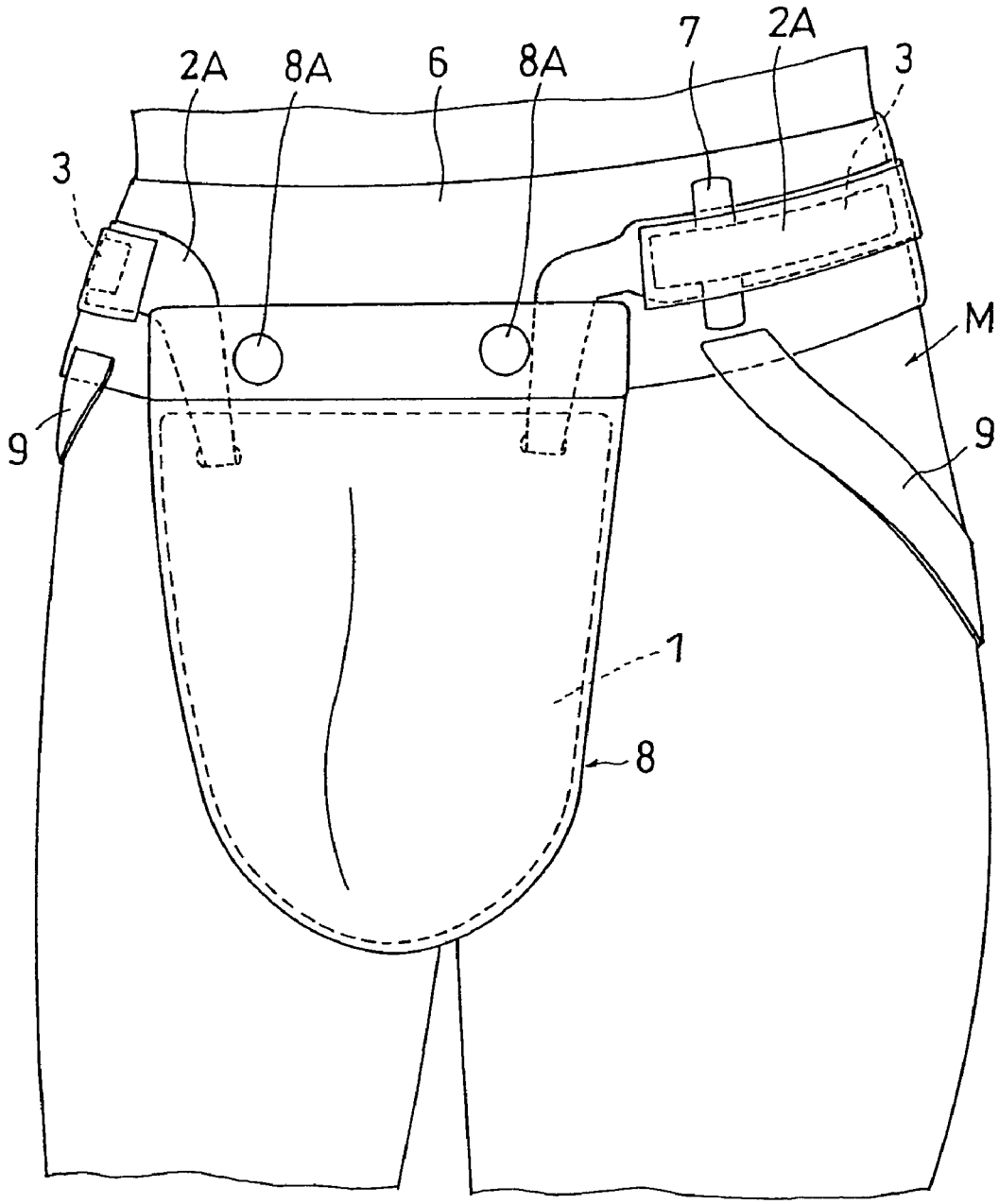

【FIG. 2】
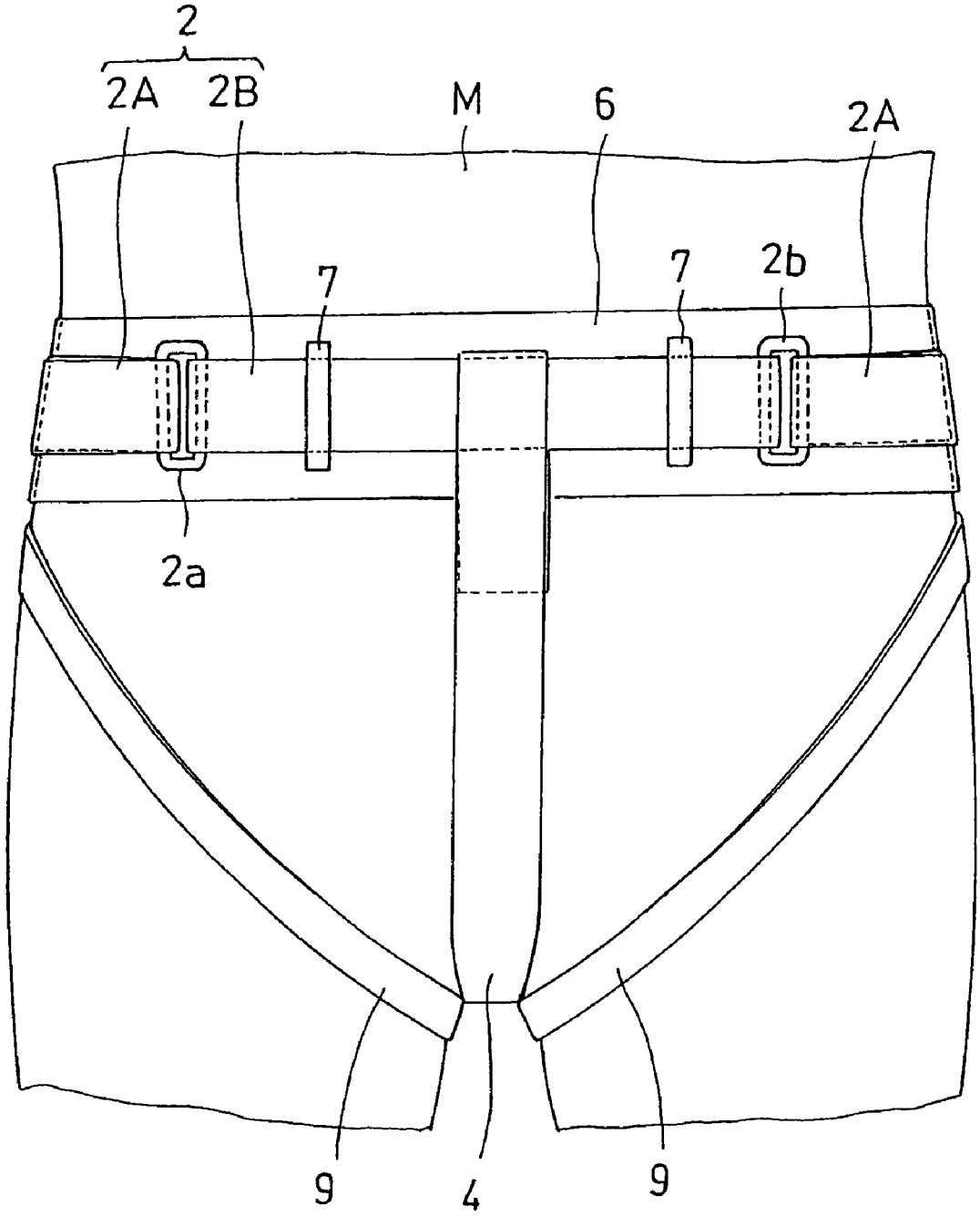

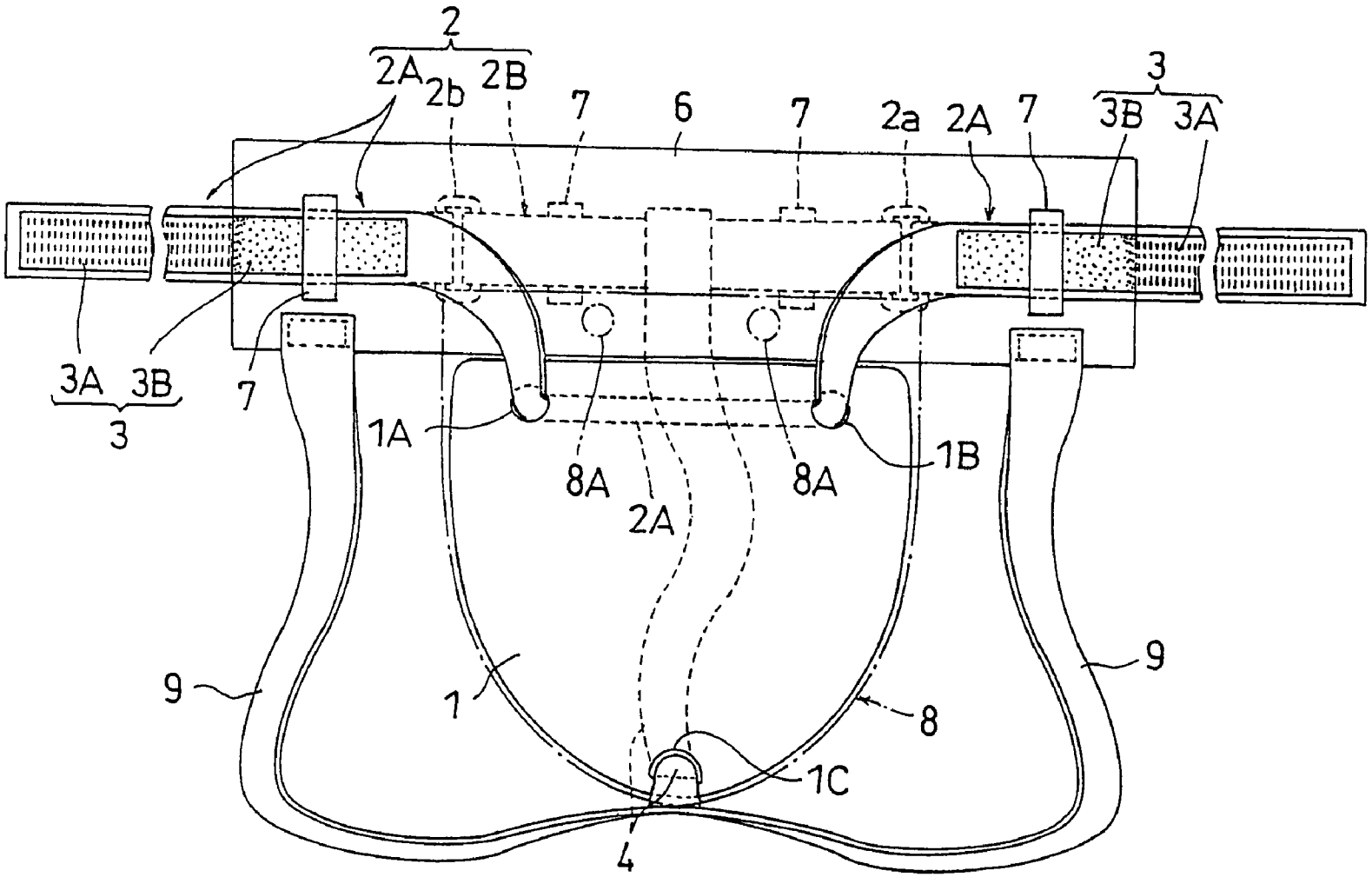
[FIG. 3]

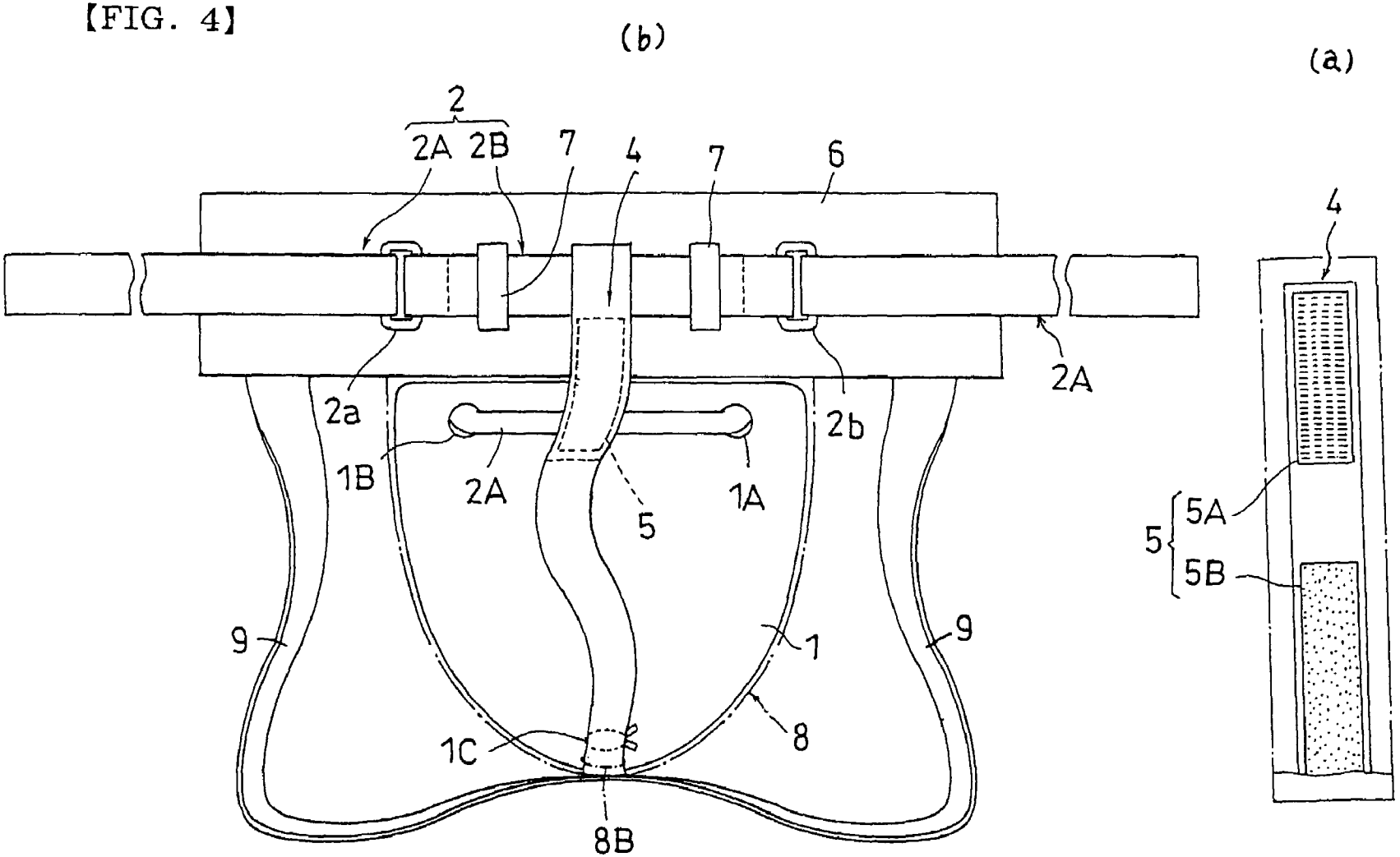
【FIG. 4】

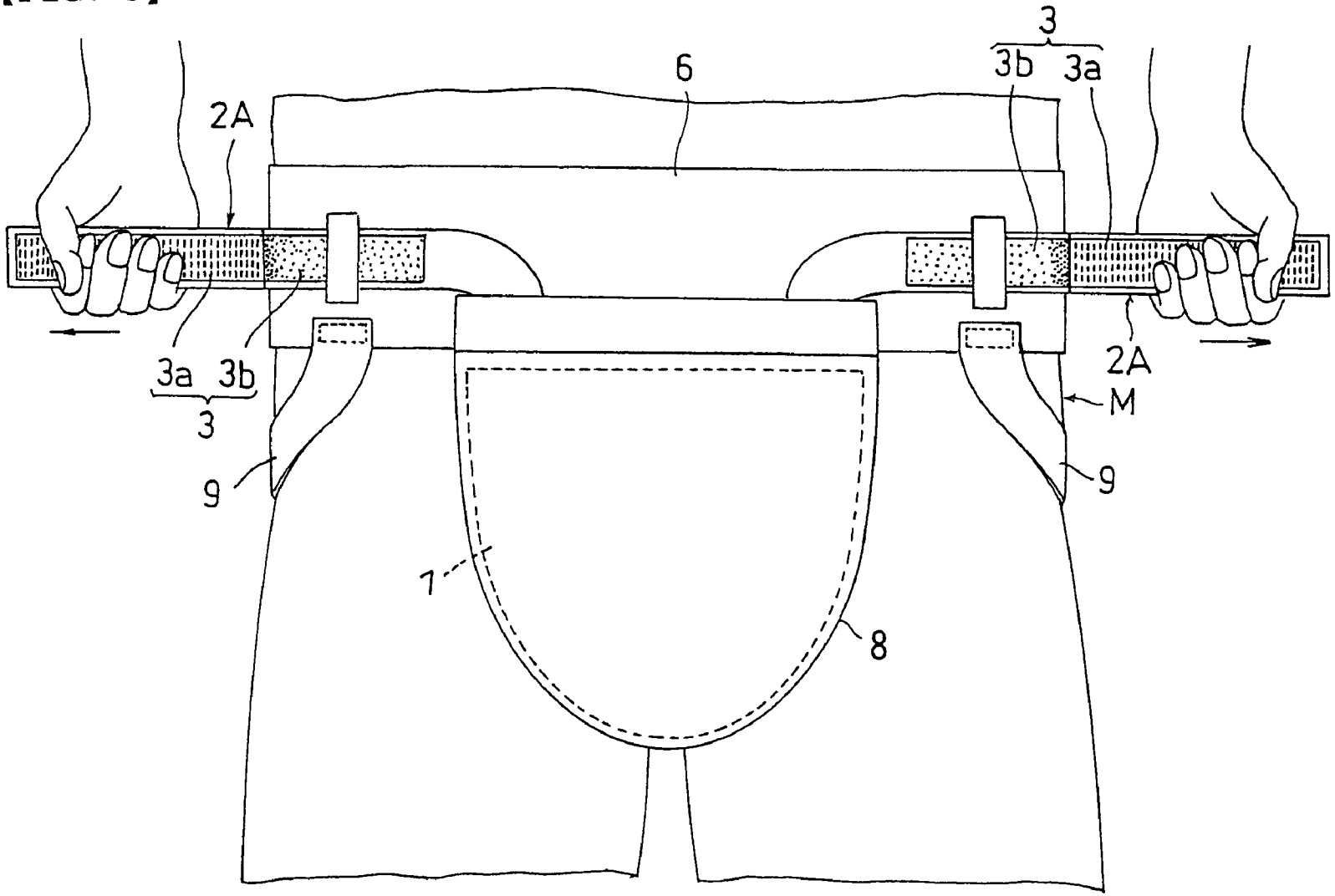
【FIG. 5】

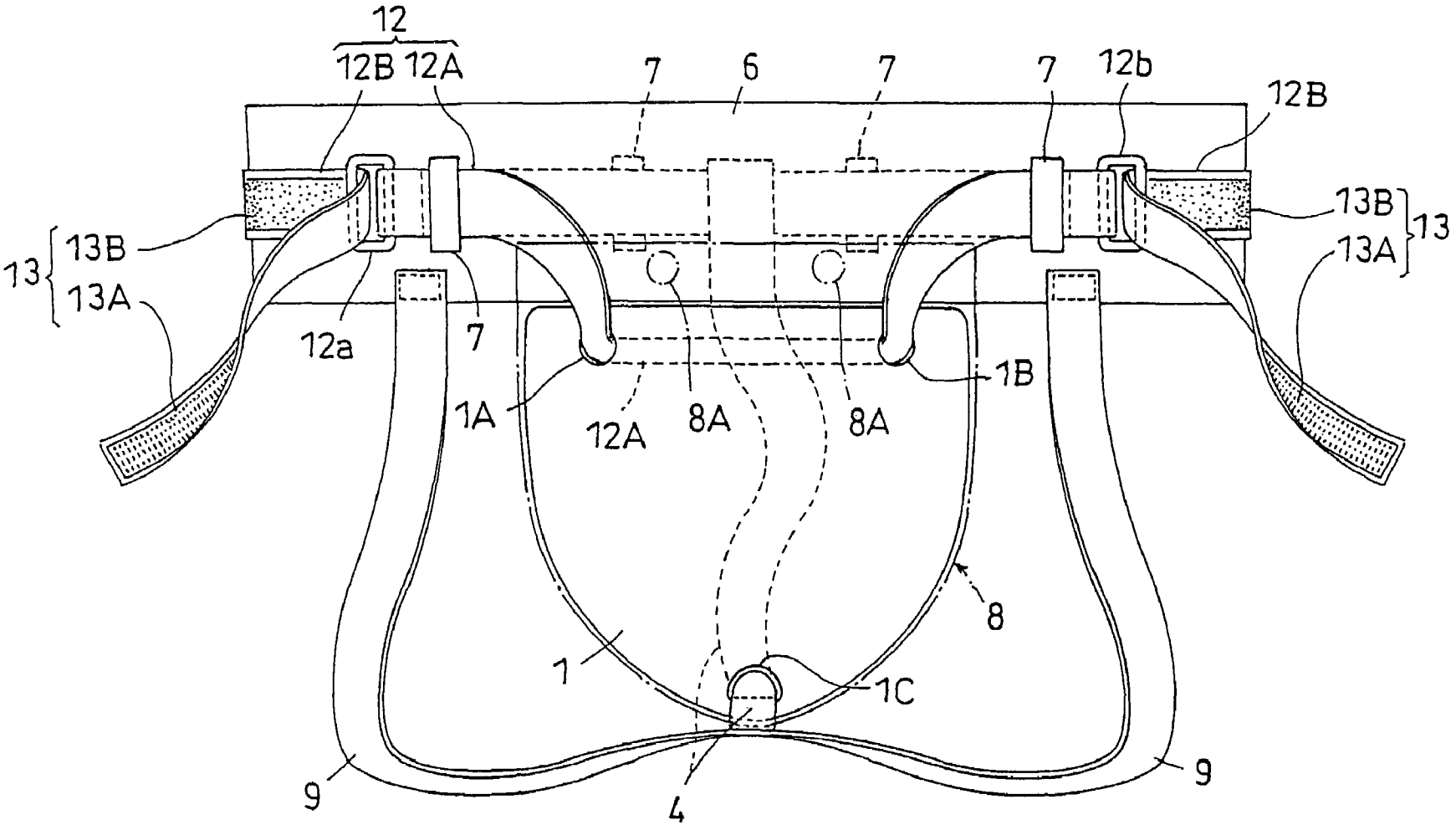
[FIG. 6]

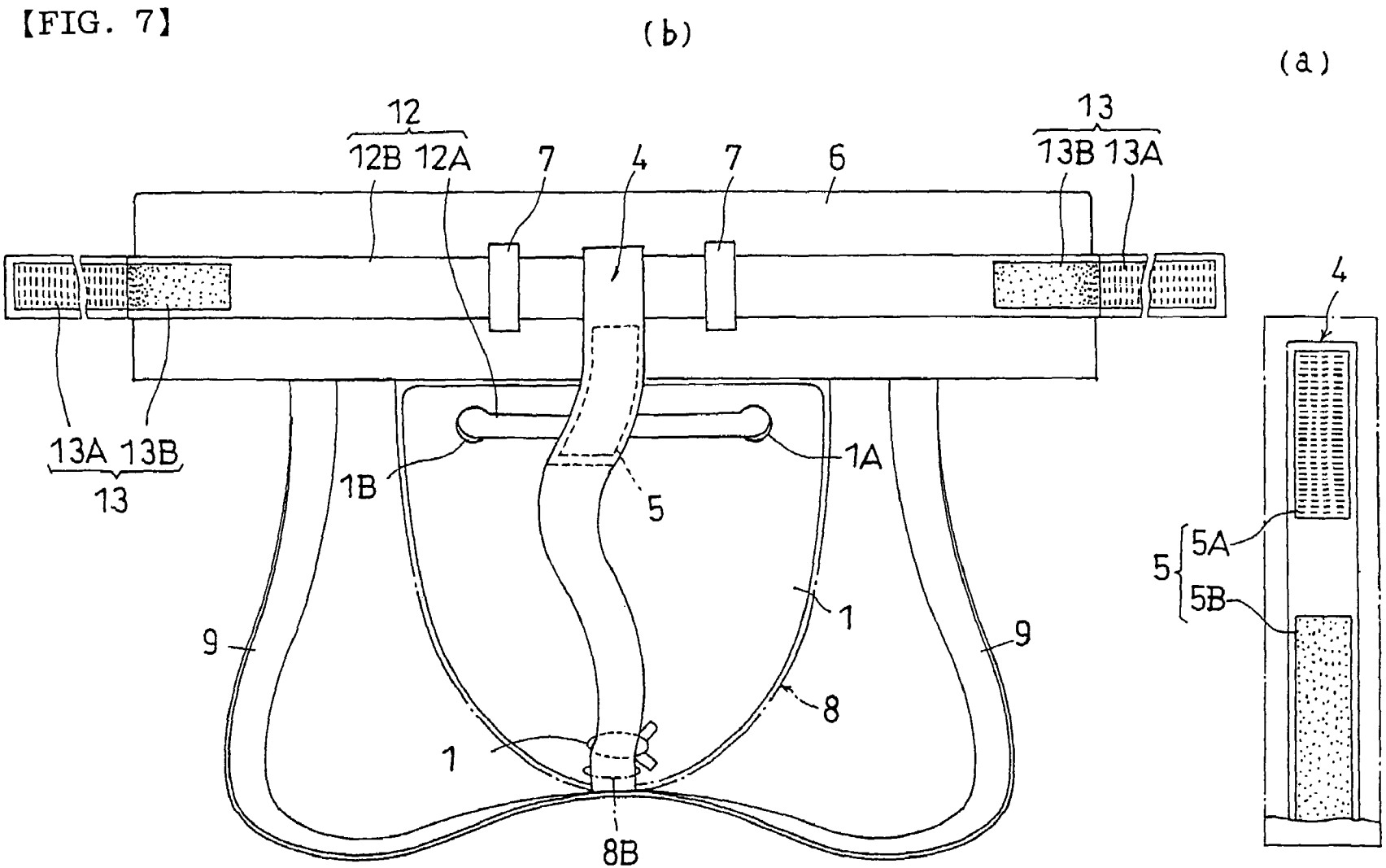
【FIG. 7】

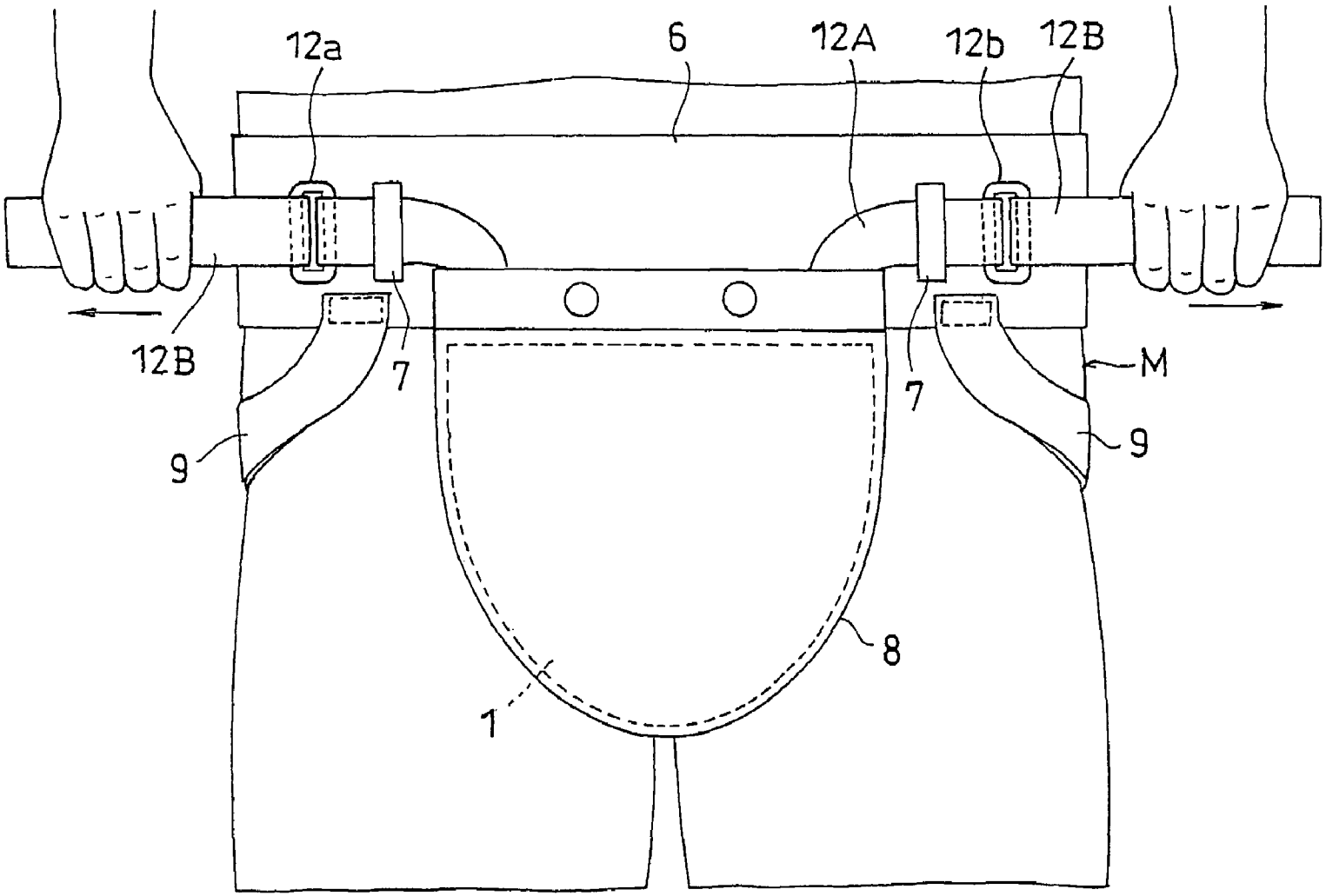
【FIG. 8】

【FIG. 9】
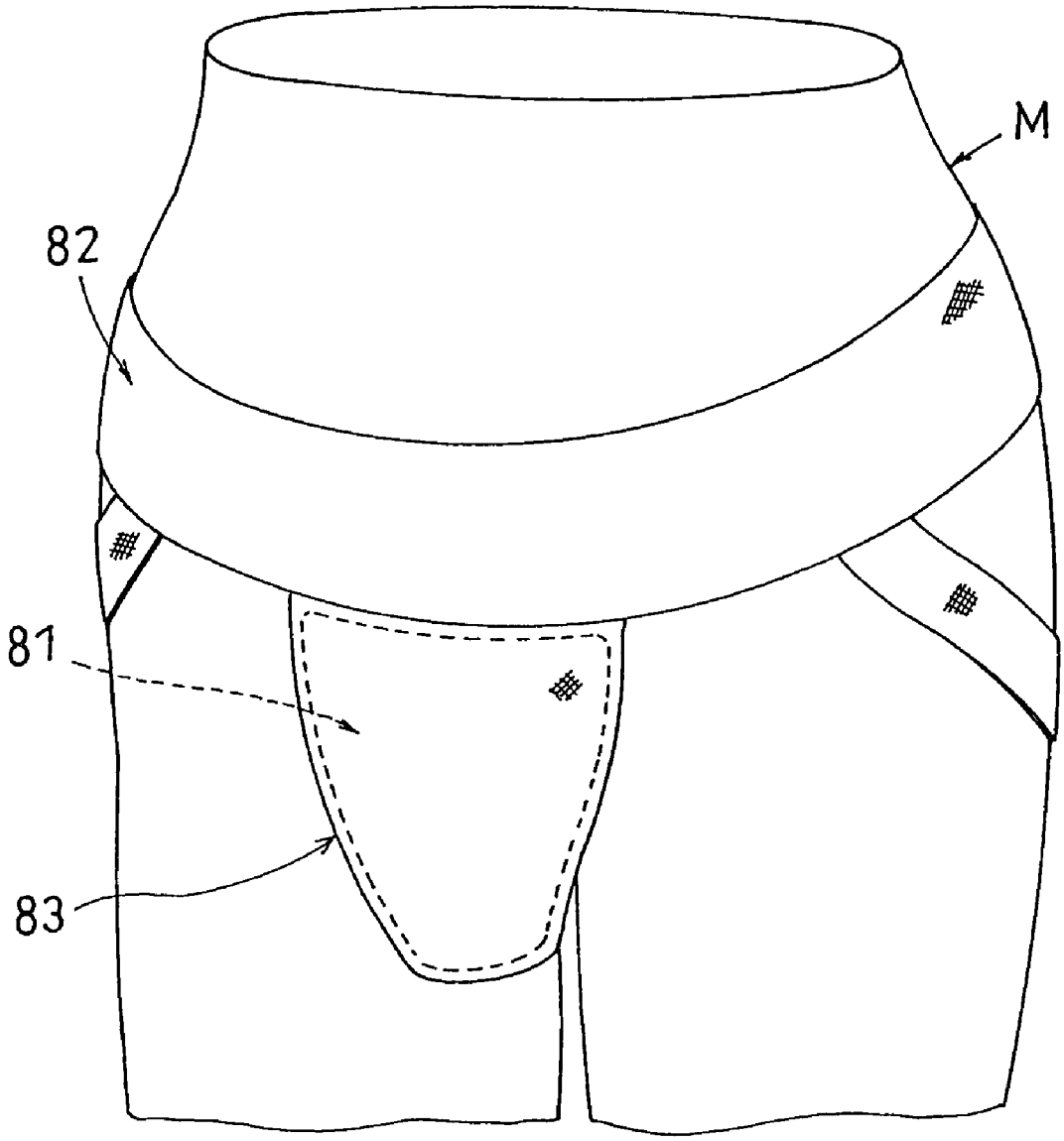
Prior Art

【FIG. 10】
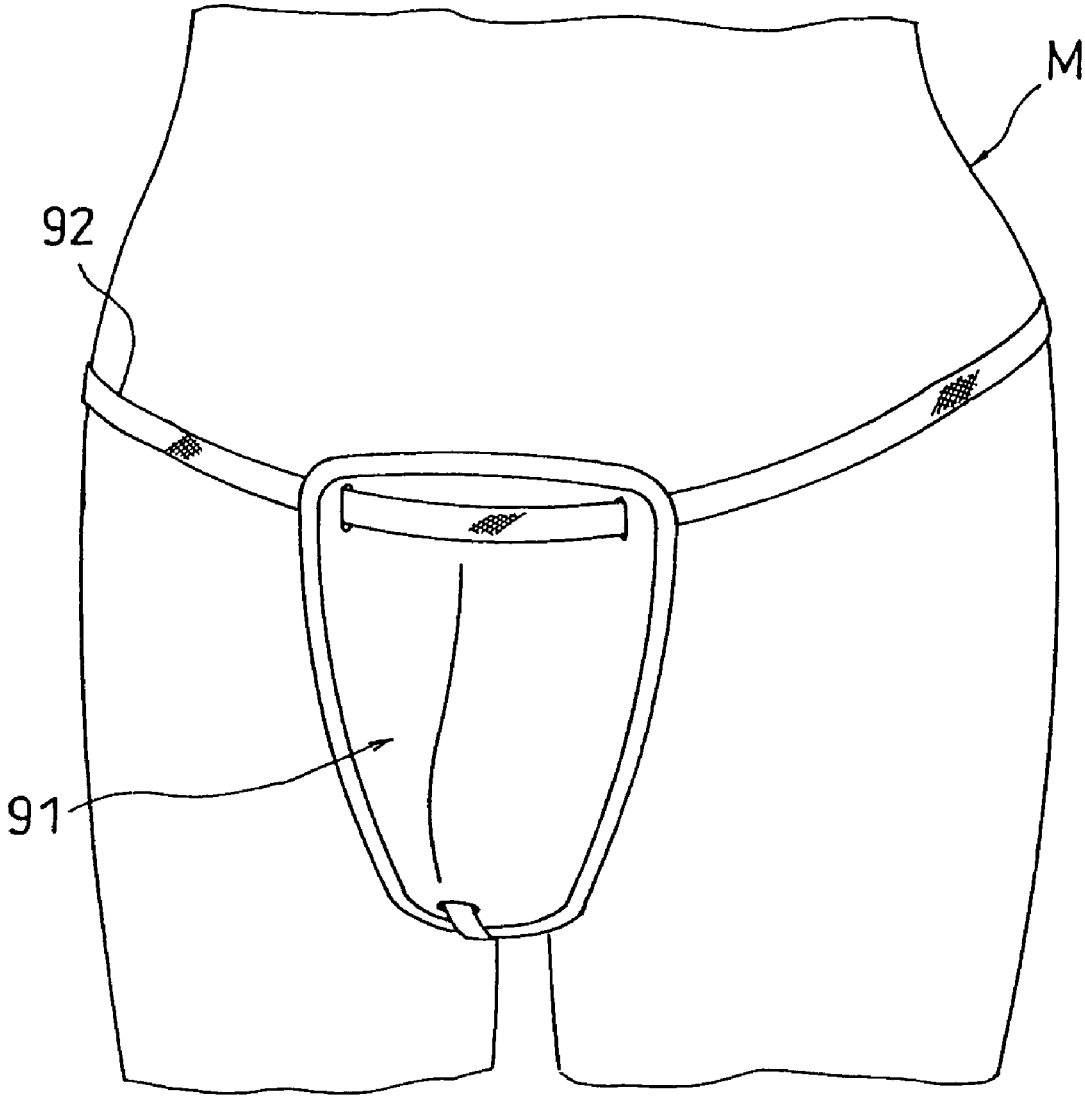
Prior Art

GROIN PROTECTOR FOR COMBAT SPORTS

BACK GROUND OF THE INVENTION

1. Field of the Invention

The present invention relates to a groin protector for combat sports, and more particularly, to a tool used for the combat sports such as karate, kickboxing and tae kwon do, and more particularly, the invention relates to a groin protector for combat sports having a plate-like rigid body which is applied to a groin of a player and which is formed into a substantially inversed triangular shape, as a groin protector body for protecting a groin jugular of the player during a match of the combat sports.

2. Description of the Related Art

In recent years, when a match or training of karate or tae kwon do, in order to protect a groin jugular of a player from erroneous punch or kick by the other player, groin protectors for combat sports shown in FIGS. 9 and 10 are used. The groin protector shown in FIG. 9 includes a plate-like rigid body 81 which is formed into a substantially inversed triangular shape as a groin protector body, and a waist fitting belt 82 made of elastic band-like member to be wound around the hip of the player M for wearing the protector body. The plate-like rigid body 81 is put in a cloth bag body 83, and in this state, the plate-like rigid body 81 is attached on the waist fitting belt 82 such that the plate-like rigid body 81 is suspended together with the cloth bag body 83.

The groin protector shown in FIG. 10 also includes a plate-like rigid body 91 which is formed into a substantially inversed triangular shape as the groin protector body. The groin protector also includes a waist tightening band 92 made of inelastic flat strap member which is wound around the hip of the player M and tied for wearing the protector body. The plate-like rigid body 91 is suspended and attached on the waist tightening band 92.

In the case of the former groin protector for combat sports, as shown in FIG. 9, the player M fits the waist fitting bent 82 to his hip and wears the protector, applies the plate-like rigid body 81 to the grain of the player M so as to protect his groin jugular from the other player's erroneous punch or kick. In the case of the latter groin protector for combat sports, as shown in FIG. 10, the player M winds the waist tightening band 92 around his hip and ties the band, applies the plate-like rigid body 91 to the groin of the player M, thereby protecting his groin jugular.

In the case of the groin protector for combat sports shown in FIG. 9, however, a fastening force applied to the hip of the waist tightening band 82 is only an elastic force of the waist fitting belt 82 and thus, the fastening force of the waist fitting belt 82 to the hip is prone to be inefficient, and there is a problem that the waist fitting bent 82 frequently Moves around the hip and the plate-like rigid body 81 is deviated in position by fierce motion during a match. If the plate-like rigid body 81 is deviated in position, the protection of the groin jugular becomes incomplete.

According to the groin protector for combat sports shown in FIG. 10, it takes time to strongly tie the waist tightening band 92 around the hip of the player M or untie the strongly tied waist tightening band 92, and there is a problem that it takes time to wear and take off the protector. If it takes time to wear and take off the groin protector for combat sports, this is inconvenient and is not practical. There is also a problem that the waist tightening band 92 easily damages a skin of the player during fierce motion, and there is another problem that the waist tightening band 92 is prone to be loosened due to abdominal breathing during a match.

SUMMARY OF THE INVENTION

The present invention has been accomplished in view of the problems of the conventional techniques, and it is an object of the invention to provide a convenient groin protector for combat sports capable of reliably preventing the position of the plate-like rigid body of the groin protector body from being deviated during a match, and capable of wearing and taking off the groin protector in a short time.

The above object is achieved by inventions of claims. That is, the present invention provides a groin protector for combat sports having a plate-like rigid body which is applied to a groin of a player and which is formed into a substantially inversed triangular shape, as a groin protector body for protecting a groin jugular of the player during a match of the combat sports, wherein the groin protector further comprises, for wearing the protector body, a waist bent made of inelastic band-like member which is attached such that the plate-like rigid body is suspended and which is wound around and attached to a hip of the player, and a surface fastener type belt retaining mechanism which retains so that the waist belt is not loosened in a state in which the waist belt is wound around the hip of the player and fastened.

According to this constitution, when the groin protector for combat sports (simply, "groin protector" hereinafter) is to be attached, the waist belt attached such that the plate-like rigid body for the groin protector body is suspended is wound around the hip of the player and fastened such that the plate-like rigid body is located at the groin jugular of the user. Then , the waist belt is retained in this state such that the waist belt is not loosened by the surface fastener type bent retaining mechanism. With this, since the plate-like rigid body is held against the groin jugular of the player, it is possible to protect the groin jugular from impact of erroneous punch or kick by the other player.

Since the waist belt for retaining the plate-like rigid body for the groin protector body is made of inelastic band-like member, the fastening force of the waist bent exhibited when the surface fastener type belt retaining mechanism retains the waist bent acts as a retaining force of the waist belt to the hip as it is. Therefore, if the belt is tightly fastened when the waist belt is retained by the surface fastener type belt retaining mechanism, the retaining force of the waist belt becomes strong, and the waist belt can be strongly retained to the hip of the player. As a result, even if the player moves intensively, the waist belt does not move and the plate-like rigid body is less prone to be deviated in position. Thus, according to the groin protector of the present invention, it is possible to reliably prevent the position of the plate-like rigid body for the groin protector body from deviating during a match.

The groin protector of the present invention includes the surface fastener type belt retaining mechanism for retaining the waist belt to the hip of the player. When the groin protector is to be attached, the waist belt is wound around the hip of the player and fastened and then, the waist belt is retained by the surface fastener type belt retaining mechanism with one-touch operation. With this, the groin protector can be attached. When the groin protector is to be detached, the retention of the waist belt by the surface fastener type belt retaining mechanism is released with one-touch operation and if the waist belt is released, the groin protector can be detached. Thus, according to the groin protector of the invention, the groin protector can be attached and detached in a short time.

It is preferable that the groin protector further comprises a center belt which is wound around and attached to a lower end side portion of the plate-like rigid body and a back side portion of the waist belt and which is held against and attached to a groin of the player, and a length of the center belt is adjustable.

According to this constitution, when the groin protector is to be attached, the center belt held against the groin of the player is wound around and attached to the lower end side portion of the plate-like rigid body and the back side portion of the waist belt. Therefore, as the waist belt is fastened, the center belt is also fastened such as to tight the groin, and as the waist bent is retained, the center belt is also retained to the hip of the player. Therefore, the plate-like rigid body for the groin protector body is strongly fixed by both the waist beat and the center belt retained to the hip of the player, and it is possible to reliably prevent the position of the plate-like rigid body for the groin protector body from deviating during a match.

In order to fasten the center belt as the waist belt is fastened, the center belt must have an appropriate length, but since the length of the center belt can be adjusted, if the length of the center belt is adjusted to the user's groin jugular only for the first times the attaching and detaching operations of the center belt can be carried out automatically as the waist belt is attached and detached. Thus, even if the center belt is provided, no extra time is required for attaching and detaching the groin protector.

It is preferable that the groin protector further comprises a loop under belt 6 made of elastic band-like member which is fitted to the hip of the player, the waist belt is wound over the loop under belt, and the loop under belt is fastened to the hip of the player together with the waist belt.

According to this constitution, when the groin protector is to be attached, the loop under belt is fitted to the hip and then the waist belt is wound and fastened. Therefore, since the loop under belt is interposed between the waist belt and the hip of the player, even if the waist belt is fastened strongly, the player does not feel pain. Since the waist belt is strongly fastened and the waist belt is retained to the hip of the player, it is possible to further prevent the position of the plate-like rigid body for the groin protector body from being deviated during a match.

It is only necessary to attach or detach the loop under belt to or from the hip when the groin protector is to be attached. Thus, even if the loop under belt is provided, no extra labor is required for attaching and detaching the groin protector. The loop under belt made of elastic band-like member is strongly retained to the hip of the player by both the elastic force of the loop under belt itself and the fastening force by the waist belt. Thus, even if the player moves intensively during a match, the loop under belt and the waist belt thereon are not moved easily.

BRIEF DESCRIPTION OF THE DRAWINGS

FIG. 1 is a perspective view of a wearing state of a groin protector according to a first embodiment of the present invention;

FIG. 2 is a rear view showing the wearing state of the groin protector shown in FIG. 1;

FIG. 3 is a front view showing a non-wearing state of the groin protector shown in FIG. 1;

FIG. 4 is a rear view showing the non-wearing state of the groin protector shown in FIG. 1;

FIG. 5 is a front view showing a fastening state of a waist belt of the groin protector shown in FIG. 1;

FIG. 6 is a front view of a non-wearing state of a groin protector according to a second embodiment of the invention;

FIG. 7 is a rear view of the non-wearing state of the groin protector shown in FIG. 6;

FIG. 8 is a front view showing a fastening state of a waist belt of the groin protector shown in FIG. 6;

FIG. 9 is a perspective view of an attached state of a conventional groin protector; and FIG. 10 is a perspective view of an attached state of another conventional groin protector.

DESCRIPTION OF THE PREFERRED EMBODIMENTS

Embodiment of the present invention will be explained in detail with reference to the drawings.

Embodiment 1

FIG. 1 is a perspective view of a wearing state of a groin protector for combat sports according to a first embodiment. FIG. 2 is a rear view showing the wearing state of the groin protector of the first embodiment. FIG. 3 is a front view showing a non-wearing state of the groin protector of the first embodiment. FIG. 4 is a rear View showing the non-wearing State of the groin protector of the first embodiment. In FIGS. 3 and 4, the cloth bag body is shown with chain lines. Examples of the combat sports in which the groin protector of the first embodiment is used are karate, kickboxing, tae Kwon do and the line.

The groin protector of the first embodiment As provided at its front surface with a plate-like rigid body 1 which is applied to a groin of the player M and which is formed into a substantially inversed triangular shape. The plate-like rigid body 1 is for a groin protector body protecting the groin Jugular of the player M (during a match of combat sports. Examples of materials of the plate-like rigid body 1 are resin material having excellent shock resistance such as ABS resin, and light metal such as aluminum. In the case of a groin protector for men, the plate-like rigid body 1 forwardly protrudes to cover a bulge of the groin. In the case of a groin protector for women, the forward protrusion of the plate-like rigid body 1 is smaller than that of the groin protector for men.

In the case of the groin protector of the first embodiment, the plate-like rigid body 1 is attached such as to be suspended. The groin protector includes, for wearing the protector body, a waist belt 2 made of inelastic band-like member which is wound around the hip of the player M. The groin protector also includes, for wearing the protector body, a surface fastener type belt retaining mechanism 3 (usually called VELCRO®, a hook and loop material) for retaining the waist belt 2 in a state in which the waist belt 2 is wound around the hip of the player M and fastened.

As shown in FIGS. 1 to 3, the waist belt 2 comprises a front side belt piece 2A and a back side belt piece 2B. As shown fin FIG. 3, left and right portions of an upper portion of the plate-like rigid body 1 are formed with openings 1A and 1B. The front side belt piece 2A As inserted into one of the openings 1A and is and pulled out from the other opening. With this, the plate-like rigid body 1 is suspended and attached on the waist belt 2. As shown in FIG. 4, relay rectangular rings 2*a* and 2*b* are disposed between the front side bent piece 2A and the back side belt piece 2B, one end of the front side bent piece 2A is passed into the rectangular ring 2*a* and is folded back, and the other end of the front aide belt piece 2A is passed through the rectangular ring 2*b* and is folded back. In this manner, the front side belt piece 2A is engaged with the rectangular rings 2*a* and 2*b*. The rectangular rings 2*a* and 2*b* are made of resin or metal (light metal such as aluminum is preferable). If the rectangular rings 2*a* and 2*b* have appropriate strength, materials thereof are not especially limited.

One end of tine back side belt piece 2B is passed through the rectangular ring 2*a* and folded back and then is filled to the bent itself. The other end of the back side bent piece 21 is passed through the rectangular ring 2*b* and folded back and then is fixed. With this, the back side belt piece 2B is engaged with the rectangular rings 2*a* and 2*b*. The front side belt piece 2A and the back side belt piece 2B are connected to each other through engagements of the rectangular rings 2*a* and 2*b*, thereby constituting one belt.

In the case of the waist beat 2, as show in FIG. 3, one end and the other end of the front side belt piece 2A are provided with the surface fastener type belt retaining mechanism 3 comprising a retaining side fastener piece 3A and a receiving side fastener piece 3B. The waist belt 2 can be retained with one-touch operation only by pushing the retaining side fastener piece 3A against the receiving side fastener piece 3B. On the other hand, the waist belt 2 can be released with one-touch operation only by peeling off the retaining side fastener piece 3A from the receiving side fastener piece 3B. A length of each of the retaining side fastener piece 3A and the receiving side fastener piece 3B is set to about 15 to 20 cm so that different sizes of hips of players can be covered.

In the came of the groin protector of the first embodiment, as shown in FIGS. 3 and 4(*b*), the grain protector includes a center belt 4 which is wound around a lower end side portion of the plate-like rigid body 1 and a back side portion of the waist belt 2. The center belt 4 is applied to the groin of the player M. A length of the center belt 4 can be adjusted. A tip end of one end of the center belt 4 is attached on a back side of the lower end side portion of the plate-like rigid body 1, and is pulled out from the opening 1C of the plate-like rigid body 1 and would toward the back. More specifically, the tip end of the one end of the center belt 4 is tied and formed into a first so that the center belt 4 is not pulled out of the opening 1C, and the tip end of the one end of the center belt 4 is attached on the lower end side portion of the plate-like rigid body 1.

On the other hand, the other end of the center belt 4 is attached An such a manner that the other end is folded back at the back side belt piece 2B and then, the other end is retained by a surface fastener type belt fixing mechanism 5 and engaged with the back side belt piece 2B. As shown film FIG. 4(*a*), the surface fastener type belt fixing mechanism 5 comprises a retaining side fastener piece 5A attached on the other end of the center belt 4, and a receiving side fastener piece 5B attached at a location short of the other end. A length of the center belt 4 can easily be adjusted by changing the retaining positions of the retaining side fastener piece 9A and the receiving side fastener piece 5B.

As shown in FIGS. 1 to 4(*b*), the groin protector also includes a loop under belt 6 made of elastic thick band-like member. The loop under bent 6 is fitted to the hip of the player M, the waist beat 2 is wound from above amid the loop under belt 6 is fastened to the hip of the player M together with the waist belt 2. The width of the loop under bent 6 is about three times the waist belt 2, and if the player M fits the loop under belt 6 to the hip while stretching the loop under belt 6 using his hands and then if the player M releases his hands, the loop under belt 6 is shrunk by its own elasticity and the loop under belt 6 fastens the hip of the player M.

A plurality of belt-through pieces 7 are attached on a surface of the loop under belt 6 along the circumferential direction. The waist belt 2 is drawn through the belt-through pieces 7. As the loop under belt 6 is fitted to the hip of the player M, the waist belt 2 does not drop and the waist belt 2 stays on the surface of the loop under belt 6.

A cloth bag body 8 is suspended from a front surface of the loop under belt 6. The plate-like rigid body 1 is accommodated in the cloth bag body 8. An upper end of the cloth bag body 8 is fixed to a lower side portion of the loop under belt 6. By releasing a hook 8A, the cloth bag body 8 is opened. As shown in FIG. 4(*b*), the center belt 4 is pulled out from a small hole 8B provided in a lower end of the cloth bag body 8. The suspended state of the plate-like rigid body 1 is held by the cloth bag body 8, and the plate-like rigid body 1 is retained more stably at the groin jugular position.

As shown in FIGS. 1 to 4(*b*), the groin protector of the first embodiment also includes thigh fitting-in belts 9 and 9 made of elastic thin band-like member. The thigh fitting-in belts 9 and 9 are passed between left and right portions of the lower side of the front surface of the loop under belt 6 through the lower side portion of the plate-like rigid body 1. When the loop under belt 6 is fitted to the hip, if left and right legs are inserted inside the thigh fitting-in belts 9 and 9, the thighs of the player M are fitted to the insides of the thigh fitting-in beats 9 and 9, and the groin protector As pulled toward the hip of the player M from opposite sides. Thus, the plate-like rigid body 1 stays stably at the position of the groin jugular.

When the player M wears the groin protector of the first embodiment explained above, the player M enters his or her left and right legs inside the thigh fitting-in belts 9 and 9 and applies the center belt 4 to the groin, and fits the loop under belt 6 to the hip such that the plate-like rigid body 1 comes front. As the loop under beat 6 is fitted to the hip, the waist belt 2 As also wound around the hip of the player M. As shown in FIG. 5, the player M grasps the right end and the left end of the front side belt piece 2A with his or her left and right hands and pulls the ends strongly to fasten the waist belt 2, and holds the retaining side fastener piece 3A against the receiving side fastener piece 3B, and retains the waist belt 2 (with one-touch operation). With this, the player M can wear the groin protector. If the player M wears the groin protector, since the plate-like rigid body 1 is held against the groin jugular of the player M, the groin jugular can be protected against erroneous punch or kick.

On the other hand, when the player M takes off the groin protector of the first embodiment, the player M peels the retaining side fastener piece 3A from the receiving side fastener piece 3B, releases the retention of the waist belt 2 and then, releases the loop under belt 6 from the hip of the player M together with the waist belt 2 and the like. With this, the player M can take off the groin protector. Therefore, the player M can wear and take off the groin protector of the first embodiment in a short time.

In the case of the groin protector of the first embodiment, since the waist belt 2 for retaining the plate-like rigid body 1 is made of inelastic band-like member, the fastening force of the waist belt 2 exhibited when the surface fastener type belt retaining mechanism 3 retains the waist belt 2 acts as a retaining force of the waist belt 2 to the hip as it is. Therefore, if the belt is tightly fastened when the waist belt 2 is retained by the surface fastener type belt retaining mechanism 3, the retaining force of the waist belt 2 becomes strong, and the waist belt 2 can be strongly retained to the hip of the player M. As a result, even if the player M moves intensively during a match, the waist belt 2 does not move and the plate-like rigid body 1 is less prone to deviated in position. Thus, according to the groin protector of the first embodiment, it is possible to reliably prevent the position of the plate-like rigid body 1 for the groin protector body from deviating during a match.

According to the groin protector of the first embodiment, when the groin protector is to be attached, the center belt 4 held against the groin of the player M is attached such that the center belt 4 is wound around the lower end side portion of the plate-like rigid body 1 and the back side portion if the waist belt 2. Thus, as the waist belt 2 is fastened, the center belt 4 is also fastened such as to tight the groin, and as the waist belt 2 is retained, the center belt 4 is also retained to the hip of the player M. Therefore, the plate-like rigid body 1 is strongly fixed by both the Waist belt 2 and the center belt 4 which are retained to the hip of the player M. As a result, the position of the plate-like rigid body 1 is reliably prevented from being deviated during a match.

In order to fasten the center belt 4 as the waist belt 2 is fastened, the center belt 4 must have an appropriate length, but since the length of the center belt 4 can be adjusted, if the length of the center belt 4 is adjusted to the user's groin jugular only for the first time, the attaching and detaching operations of the center belt 4 can be carried out automatically as the waist belt 2 is attached and detached. Thus, even if the Center belt 4 is provided, no extra time is required for attaching and detaching the groin protector.

When the groin protector is to be attached, the loop under belt 6 is fitted to the hip and then the waist belt 2 is wound and fastened. Therefore, since the loop under belt 6 is interposed between the waist belt 2 and the hip of the player M, even if the waist belt 2 is fastened strongly, the player M does not feel pain. since the waist belt 2 is strongly fastened and the waist belt 2 is retained to the hip Of the player M, it is possible to further prevent the position of the plate-like rigid body 1 from being deviated during a match. It is only necessary to attach or detach the loop under belt 6 to or from the hip when the groin protector is to be attached. Thus, even if the loop under belt 6 is provided, no extra labor is required for attaching and detaching the groin protector. The loop under belt 6 made of elastic band-like member is strongly retained to the hip of the player M by both the elastic force of the loop under belt 6 itself and the fastening force by the waist belt 2. Thus, even if the player M moves intensively during the match, the loop under belt 6 and the waist belt 2 thereon are not moved easily.

In addition, concerning the thigh fitting-in belts 9 and 9 by which the groin protector is pulled toward the hip of the player M from left and right sides and the plate-like rigid body 1 is stably retained to the position of the groin jugular, when the loop under belt 6 is fitted to the hip, left and right legs enter inside the thigh fitting-in belts 9 and 9. Thus, even if the thigh fitting-in belts 9 and 9 are provided, no extra labor is required for attaching and detaching the groin protector.

Embodiment 2

FIG. 6 is a front view showing a groin protector of a second embodiment in its non-wearing state. FIG. 7 is a rear view of the groin protector of the second groin protector in its non-wearing state. In FIGS. 6 and 7, the cloth bag body is shown with chain lines. As shown in FIGS. 6 and 7(*a*) and (*b*), the groin protector of the second embodiment is different from that of the first embodiment only in the structure of the waist belt 12 and the surface fastener type belt retaining mechanism 13 as will be described later. Since the groin protector of the second embodiment is substantially the same as the groin protector of the first embodiment, explanation of the same portions will be omitted, and only different portions will be explained.

The waist belt 12 comprises a front side belt piece 12A and a back side belt piece 12B. Left and right portions of an upper portion of the plate-like rigid body 1 are formed with openings 1A and 1B. The front side belt piece 12A is inserted into one of the openings 1A and 1B and pulled out from the other opening. With this, the plate-like rigid body 1 is suspended and attached on the waist belt 12. Relay rectangular rings 12*a* and 12*b* are disposed between the front side belt piece 12A and the back side belt piece 12B, one end of the front side belt piece 12A is passed into the rectangular ring 12*a* and is folded back and then fixed to the belt itself, and the other end of the front side belt piece 12A is passed through the rectangular ring 12*b* and is folded back and then fixed to the belt itself. With this, the front side belt piece 12A is engaged with the rectangular rings 12*a* and 12*b*. One end of the back side belt piece 12B is passed through the rectangular ring 12*a*and is folded back, the other end of the back side belt piece 12B is passed through the rectangular ring 12*b* and then folded back. With this, the back side belt piece 12B is engaged with the rectangular rings 12*a* and 12*b*. The front side belt piece 12A and the back side belt piece 12B are connected to each other through engagements of the rectangular rings 12*a* and 12*b*, thereby constituting one belt.

In the case of the wallet belt 12, one end and the other end of the back side belt piece 12B are provided with the surface fastener type belt retaining mechanism 13 comprising a retaining side fastener piece 13A and a receiving side fastener piece 13B. The waist belt 12 can be retained with one-touch operation only by pushing the retaining fastener piece 13A against the receiving side fastener piece 13B. On the other hand, the waist belt 12 can be released with one-touch operation only by peeling off the retaining side fastener piece 13A from the receiving side fastener piece 13B. A length of each of the retaining side fastener piece 13A and the receiving side fastener piece 13B is set to about 15 to 120 cm so that different sizes of hips of players can be covered.

When the player M wears the groin protector of the second embodiment explained above, the player M enters his or her left and right legs inside the thigh fitting-in belts 9 and 9 and applies the center belt 4 to the groin, and its t the loop under belt 6 to the hip such that the plate-like rigid body 1 comes front. As the loop under belt 6 is fitted to the hip, the waist belt 12 is also wound around the hip of the player M. As show in FIG. 8, the player M grasps the right end and the left end of the back side belt piece 12A with his or her left and right hands and pulls the ends strongly to fasten the waist belt 12, and holds the retaining side fastener piece 13A against the receiving side fastener piece 13B, and retains the waist belt 12 (with one-touch operation). With this, the player M can wear the groin protector.

MODIFICATION

In the above embodiments, each of the waist belts 2 and 12 comprises the front side belt piece and the back side belt piece, but it is not always to divide the waist belt into the front side belt piece and the back side belt piece, and the waist belt may integrally be provided with these pieces.

What is claimed is:

1. A groin protector for combat sports comprising a plate-like rigid body which is applied to a groin of a player and which is formed into a substantially inversed triangular shape, as a groin protector body for protecting a groin jugular of the player during a match of the combat sports, wherein the groin protector further comprises, for wearing the protector body, a waist belt made of inelastic band-like member which is attached such that the plate-like rigid body is suspended from the waist belt and which is wound around and attached to a hip of the player, and a surface fastener belt retaining mechanism which retains the waist belt so that the waist belt is not loosened in a state in which the waist belt is wound around the hip of the player and fastened, and the length of the waist belt around the hip of the player is adjustable by the fastener belt retaining mechanism to locate the plate-like rigid body at the groin jugular of the player, the groin protector further comprises a center belt which is attached to a center of a lower end side portion of the plate-like rigid body, extends toward a center of a center back side portion of the waist belt, and is attached to the center back side portion of the waist belt so that the center belt is wound around through a center of the crotch of the player, and the groin protector is held against and attached to a groin of the player, wherein a length of the center belt is adjustable.

2. A groin protector for combat sports having a plate-like rigid body which is applied to a groin of a player and which is formed into a substantially inversed triangular shape, as a groin protector body for protecting a groin jugular of the player during a match of the combat sports, wherein the groin protector further comprises, for wearing the protector body, a waist belt made of inelastic band-like member which is attached such that the plate-like rigid body is suspended and which is wound around and attached to a hip of the player, and a surface fastener belt retaining mechanism which retains so that the waist belt is not loosened in a state in which the waist belt is wound around the hip of the player and fastened, the groin protector further comprises a center belt which is wound around and attached to a lower end side portion of the plate-like rigid body and a back side portion of the waist belt and which is held against and attached to a groin of the player, wherein a length of the center belt is adjustable, the groin protector further comprising a loop under belt made of elastic band-like member which is fitted to the hip of the player, wherein the waist belt is wound over the loop under belt, and the loop under belt is fastened to the hip of the player together with the waist belt.

3. The groin protector for combat sports according to claim 1, wherein the surface fastener belt retaining mechanism is provided on both right side and left side of the protector and adapted to be adjusted by right and left hands of the player, respectively.

4. A groin protector for combat sports comprising:

a plate-like rigid body which is applied to a groin of a player and which is formed into a substantially inversed triangular shape, as a groin protector body for protecting a groin jugular of the player during a match of the combat sports, a waist belt for wearing the protector body, said waist belt being made of inelastic band-like member which is attached such that the plate-like rigid body is suspended and which is wound around and attached to a hip of the player, a surface fastener belt retaining mechanism which retains so that the waist belt is not loosened in a state in which the waist belt is wound around the hip of the player and fastened, a center belt which is wound around and attached to a lower end side portion of the plate-like rigid body and a center back side portion of the waist belt and which is held against and attached to a groin of the player, wherein a length of the center belt is adjustable, and two thigh fitting-in belts for secure fitting around thighs, said thigh fitting-in belts being attached to a lower end side portion of the plate-like rigid body and right and left side portions of the waist belt, respectively.

5. A groin protector for combat sports comprising:

a plate-like rigid body which is applied to a groin of a player and which is formed into a substantially inversed triangular shape, as a groin protector body for protecting a groin jugular of the player during a match of the combat sports, a waist belt for wearing the protector body, said waist belt being made of inelastic band-like member which is attached such that the plate-like rigid body is suspended and which is wound around and attached to a hip of the player, a surface fastener belt retaining mechanism which retains so that the waist belt is not loosened in a state in which the waist belt is wound around the hip of the player and fastened, a center belt which is wound around and attached to a lower end side portion of the plate-like rigid body and a center back side portion of the waist belt and which is held against and attached to a groin of the player, wherein a length of the center belt is adjustable, and two thigh fitting-in belts for secure fitting around thighs, said thigh fitting-in belts being attached to a lower end side portion of the plate-like rigid body and right and left side portions of the waist belt, respectively, wherein the surface fastener belt retaining mechanism is provided on both right side and left side of the protector.

* * * * *

UNITED STATES PATENT AND TRADEMARK OFFICE

CERTIFICATE OF CORRECTION

PATENT NO. : 7,418,743 B2
APPLICATION NO. : 11/021584
DATED : September 2, 2008
INVENTOR(S) : Takeshi Tsujimoto It is certified that error appears in the above-identified patent and that said Letters Patent is hereby corrected as shown below:

Column 1, line 38; Change “bent” to --belt--.

Column 1, line 40; Change “grain” to --groin--.

Column 1, line 51; Change “inefficient,” to --insufficient,--.

Column 1, line 52; Change “bent” to --belt--.

Column 1, line 52; Change “Moves” to --moves--.

Column 2, line 17; Change “bent” to --belt--.

Column 2, line 31; Change “bent” to --belt--.

Column 2, line 38; Change “bent” to --belt--.

Column 2, line 40; Change “bent” to --belt--.

Column 3, line 10; Change “bent” to --belt--.

Column 3, line 12; Change “beat” to --belt--.

Column 3, line 20; Change “times” to --time--.

Column 4, line 20; Change “View” to --view--.

Column 4, line 21; Change “State” to --state--.

Column 4, line 24; Change “Kwon” to --kwon--.

Column 4, line 25; Change “line.” to --like.--.

Column 4, line 26; Change “As” to --is--.

Column 4, line 30; Change “Jugular” to --jugular--.

Column 4, line 31; Change “(during” to --during--.

Column 4, line 50; Change “fin” to --in--.

Column 4, line 53; Change “As” to --is--.

Column 4, line 54; Change “is” to --1B--.

Column 4, line 58; Change “bent” to --belt--.

Column 4, line 59; Change “bent” to --belt--.

Column 4, line 60; Change “aide” to --side--.

UNITED STATES PATENT AND TRADEMARK OFFICE

CERTIFICATE OF CORRECTION

PATENT NO. : 7,418,743 B2
APPLICATION NO. : 11/021584
DATED : September 2, 2008
INVENTOR(S) : Takeshi Tsujimoto It is certified that error appears in the above-identified patent and that said Letters Patent is hereby corrected as shown below:

Column 5, line 1; Change “tine” to --time--.

Column 5, line 2; Change “filled” to --fixed--.

Column 5, line 3; Change “bent” to --belt--.

Column 5, line 3; Change “bent” to --belt--.

Column 5, line 3; Change “21” to --2B--.

Column 5, line 10; Change “beat” to --belt--.

Column 5, line 10; Change “show” to --shown--.

Column 5, line 23; Change “came” to --case--.

Column 5, line 24; Change “grain” to --groin--.

Column 5, line 32; Change “would” to --wound--.

Column 5, line 33; Change “first” to --fist--.

Column 5, line 34; Change “of” to --from--.

Column 5, line 38; Change “An” to --in--.

Column 5, line 41; Change “film” to --in--.

Column 5, line 47; Change “9A” to --5A--.

Column 5, line 51; Change “bent” to --belt--.

Column 5, line 52; Change “beat” to --belt--.

Column 5, line 52; Change “amid” to --and--.

Column 5, line 54; Change “bent” to --belt--.

Column 6, line 18; Change “beats” to --belts--.

Column 6, line 18; Change “As” to --is--.

Column 6, line 26; Change “beat” to --belt--.

Column 6, line 27; Change “As” to --is--.

Column 6, line 67; Change “if” to --of--.

Column 7, line 5; Change “Waist” to --waist--.

UNITED STATES PATENT AND TRADEMARK OFFICE

CERTIFICATE OF CORRECTION

PATENT NO. : 7,418,743 B2
APPLICATION NO. : 11/021584
DATED : September 2, 2008
INVENTOR(S) : Takeshi Tsujimoto It is certified that error appears in the above-identified patent and that said Letters Patent is hereby corrected as shown below:

Column 7, line 16; Change “Center” to --center--.

Column 7, line 23; Change “since” to --Since--.

Column 7, line 24; Change “Of” to --of--.

Column 7, line 53; Change “structure” to --structures--.

Column 8, line 8; Change “12aand” to --12a and--.

Column 8, line 16; Change “wallet” to --waist--.

Column 8, line 21; After “retaining” insert --side--.

Column 8, line 32; Change “its t” to --fits--.

Column 8, line 35; Change “show” to --shown--.

Signed and Sealed this

Seventh Day of April, 2009

JOHN DOLL
*Acting Director of the United States Patent and Trademark Office*